US005846654A

United States Patent [19]

Modrak

[11] Patent Number: 5,846,654

[45] Date of Patent: Dec. 8, 1998

[54] HIGH TENACITY, HIGH ELONGATION POLYPROPYLENE FIBERS, THEIR MANUFACTURE, AND USE

[75] Inventor: James P. Modrak, Conyers, Ga.

[73] Assignee: Hercules Incorporated, Wilmington, Del.

[21] Appl. No.: 652,717

[22] Filed: May 30, 1996

Related U.S. Application Data

[63] Continuation-in-part of Ser. No. 458,951, Jun. 2, 1995.

[51] Int. Cl.[6] ..... D02G 3/00

[52] U.S. Cl. ..... 428/364; 428/394

[58] Field of Search ..... 428/364, 394; 526/384.1, 351

[56] References Cited

U.S. PATENT DOCUMENTS

| | | | |
|---|---|---|---|
| 4,261,754 | 4/1981 | Krenchel et al. . | |
| 4,413,110 | 11/1983 | Kavesh et al. . | |
| 4,428,775 | 1/1984 | Johnson et al. . | |
| 4,536,536 | 8/1985 | Kavesh et al. . | |
| 4,542,159 | 9/1985 | Johnson et al. . | |
| 4,769,433 | 9/1988 | Chanzy et al. . | |
| 5,578,374 | 11/1996 | Dunbar et al. | 428/364 |

FOREIGN PATENT DOCUMENTS 59179528 10/1984 Japan .

OTHER PUBLICATIONS

F. Kloos, "Dependence of Structure and Properties. . . ," *Polypropylene* Fibres and Textiles IV, 4th Int'l Conf. on Polypropylene Fibres and Textiles, Univ. of Nottingham, 23–25 Sep. 1987.

M. Ahmed, *Polypropylene Fibers—Science and Technology* (New York: Elsevier Scientific Pub. Co., 1982), pp. 389–403.

A.J. Rosenthal, "$TE^{0.5}$, An Index for Relating Fiber Tenacity and Elongation" *Symp. on Polyprop. Fibers*, So. Res. Inst., Birmingham, AL 1964.

*Primary Examiner*—Newton Edwards

*Attorney, Agent, or Firm*—Mark D. Kuller; Bradley N. Ruben

[57] ABSTRACT

Spinning polypropylene at relatively high temperatures with delayed quenching, and drawing at relatively high temperatures with moderate draw ratios, provides fibers having an improved tensile factor, especially improved elongation, and can be used to produce fibers also having a high tenacity. The fibers are particularly useful for reinforcement applications when provided in the form of staple fibers and exhibit a tensile factor $TE^{0.50}$ of at least about 60, where T is tenacity (gpd) and E is elongation (percent), especially those having a tenacity of at least about 8 gpd and/or an elongation of at least about 25%, and most especially those having a tenacity of at least about 10 gpd and elongations of 50% to 400%.

60 Claims, 2 Drawing Sheets

HIGH TENACITY, HIGH ELONGATION POLYPROPYLENE FIBERS, THEIR MANUFACTURE, AND USE

This application is a continuation-in-part of application Ser. No. 458,951, filed Jun. 2, 1995, pending, the disclosure of which is incorporated herein by reference in its entirety.

BACKGROUND OF THE INVENTION

1. Field of the Invention

The present invention relates to novel polypropylene fibers, their manufacture, and use, to novel methods for making such fibers, to novel articles reinforced with such staple fibers, especially novel reinforced cementitious articles, and to novel woven and nonwoven articles of manufacture comprising such fibers.

2. The State of the Art

One of the primary properties of textile fibers is adequate strength for the fiber to be processed and manipulated by machinery and to improve the durability of the final product. This property is important for fibers both as staple fibers and as continuous length filaments. For example, staple fibers are used to make nonwoven fabrics. One method for making nonwoven fabrics involves forming a nonwoven mat of carded, crimped, staple fibers which are then physically bonded. In these structures, where the fibers are bound to each other and do not slip past each other (as can occur in a woven fabric), staple fibers having an improved tenacity would be useful for improving the toughness of the nonwoven fabric and/or article. Among various uses for nonwoven articles are absorbing, channeling, and/or filtering liquids.

The term "tenacity" is generally defined as the tensile stress, expressed as force per unit density, and more typically expressed as grams of force per denier when the tenacity of fibers is being discussed; "tenacity" can also refer to the stress imposed on a fiber at the breaking point of the fiber. H. R. Allcock and F. W. Lampe, *Contemporary Polymer Chemistry,* 2nd Ed. (Englewood Cliffs, N.J.: Prentice Hall, 1990). The "toughness" of a fiber is considered to be proportional to the area under the load-extension (stress-strain) curve; "toughness" is another measure of resistance to breakage, and interprets the area under the stress-strain curve as the total energy input up to the breaking point. Id. Tougher fibers are valuable for the production of yarns used in sheer and lightweight woven fabrics, providing improved wearing properties. Tougher fibers are also useful for the production of yarns where the end use requires a high degree of strength, such as for woven fabrics used in the fabrication of work clothes and industrial fabrics.

Staple fibers are also used for reinforcing various engineering materials, including plastic compositions for molding, pavements (such as described in U.S. Pat. No. 285,559, filed Aug. 3, 1994, corresponding to Canadian laid-open application number 2,151,004, the disclosures of which are both incorporated herein by reference in their entirety), cements, and other curable or settable aggregates, such as plaster (gypsum) boards. The staple fibers are typically incorporated into a liquid composition prior to its being cured or set in a desired geometry. Reinforcing staple fibers having a high tenacity improve various ultimate properties of the resulting reinforced material.

The production of a high tenacity fiber is taught in the art as being related to the polymer used for spinning, the spinning conditions, and the drawing conditions. Some in the art believe that the tenacity (T) of a spun fiber is related to the molecular weight of the fiber ($MW_{fiber}$), the molecular weight of the polymer in the melt ($MW_{polymer}$), and the coefficient of variation in the denier of the fiber (C.V.), and one author provides the following equation for predicting tenacity:

$$T=A+B(MW_{fiber})+C(MW_{polymer}/MW_{fiber})-C.V.$$

where A, B, and C are constants. M. Ahmed, *Polypropylene Fibers—Science and Technology,* section III.2., "High-Tenacity Industrial Yarns," (New York: Elsevier Scientific Pub. Co., 1982) (the disclosure of which is incorporated herein by reference). There is some degradation of the polymer during spinning; hence the equation includes terms relating to molecular weight of each of the polymer melt and of the fiber. As written, the above equation implies the need for a high molecular weight and high uniformity (low C.V.) in the as-spun fiber (i.e., the solidified fiber formed directly from the spinnerette) to achieve a high tenacity.

As for spinning, some in the art suggest that the fiber be spun at as low a temperature as possible using a polymer having a high molecular weight, preferably also having a narrow molecular weight distribution, being highly stabilized, and having an intrinsic viscosity of 2–3 and a MFR (melt flow rate) of 1.5–3. As-spun melt spun fibers are suggested to be made with a denier of 10–16 dpf. It is believed by such artisans that the as-spun fiber should have a low crystallinity (smectic is described as the best form), and so they delay quenching by using a shroud (e.g., as described by Finzel et al. in U.S. Pat. No. 3,313,001, the disclosure of which is incorporated herein by reference). After the fiber emerges from the spinnerette and quenching is applied, a high quench rate is used. See, e.g., Andrzej Ziabicki, *Fundamentals of Fibre Formation* (New York: John Wiley & Sons) (the disclosure of which is incorporated herein by reference).

One of the reasons for these art-perceived constraints is that when polypropylene is used for the spinning melt it degrades as it is heated to melting, and so the melt-spun fiber often has a lower molecular weight than does the original polymer melt (as mentioned above, note that the above equation includes parameters, $MW_{fiber}$ and $MW_{polymer}$, relating to the molecular weights of each). Because it is not desirable to degrade the polymer to any significant degree, melt stabilizers are often used for spinning; at temperatures greater than about 290° C., visbreaking and total degradation of the polymer are usually initiated.

After spinning, some in the art suggest that cold drawing of the fiber is best using a low take-up speed (about 20 mpm; meters per minute) for the first set of rolls. They teach that the first drawing is performed at temperatures below 70° C. to avoid converting the smectic phase to a monoclinic crystalline form, and that subsequent drawing is at higher temperatures. They believe that the draw ratio is proportional to the strength achieved in the final fiber. See Ahmed, op. cit. Others suggest the opposite, using high draw ratios and high take-up velocities. E.g., F. Kloos, "Dependence of Structure and Properties of Melt Spun Polypropylene Fibers on Molecular Weight Distribution," *Polypropylene Fibres and Textiles IV,* Fourth International Conf. on Polypropylene Fibres and Textiles, Univ. of Nottingham, 23–25 Sep. 1987 (the disclosure of which is incorporated herein by reference).

High tenacity fibers are typically evaluated not only by their tenacity value (usually express in grams per denier, abbreviated gpd), but also by the product of their tenacity T and the square root of their percent elongation E (i.e., elongation in the elastic regime prior to reaching the yield point of the material). This relationship of $TE^{0.50}$, which is also called the tensile factor, is an approximate measure of toughness; the tensile factor for "high tenacity" fibers discussed in the literature is generally about 40. Rosenthal, A. J., in "$TE^{0.50}$, An Index for Relating Fiber Tenacity and Elongation," *Symposium on Polypropylene Fibers, Southern Research Inst.,* Birmingham, Ala., 1964, p. 182–217, describes the empirical relationship of $TE^{0.50}$. Drawn yarn tensile strengths measured from an unidentified parent polypropylene yarn are disclosed by Rosenthal as providing $TE^{0.50}$ values around 60 with tenacities less than 6.0 gpd (Table XIII, Set B). Rosenthal also teaches that individual fiber $TE^{0.50}$ values, as based on the prior work of another (W. C. Sheehan), are grossly dependent upon isotacticity and fiber molecular weight, and are maximally on the order of about 40 (Tables XIV and XV). See also, Ahmed at 390, where polypropylene $TE^{0.50}$ values likewise are maximally about 40 (Table II).

Montecatini, in GB 941,199 (the disclosure of which is incorporated herein by reference; and discussed by Ahmed) describes polypropylene fibers made from melts having intrinsic viscosities ranging from 2.00 to 3.00 and spun at spinning temperatures ranging from 250° to 295° C. The as-spun fibers were drawn at ratios of 1:6.28 to 1:10 at temperatures ranging from 130° to 150° C. The resulting fibers had tenacities ranging from 8.8 to 14.5 gpd and had elongations ranging from 14% to 23%; one example gave a tensile factor of 70 (based on T=14.5 and E=23%).

Chancy et al., in U.S. Pat. No. 4,769,433 (the disclosure of which is incorporated herein by reference), describe high tenacity polyolefin fibers made by spinning a high molecular weight ($MW \geqq 10^6$) polypropylene and then drawing at a ratio of at least 1:18 and at temperatures of 60° to 145° C. The resulting fibers have elongations of about 5%.

Sumitomo Chemical, in JP 48-82116 (the disclosure of which is incorporated herein by reference), describe high tenacity polypropylene fibers with a tenacity of at least 8 gpd and a tensile factor of about 40 by drawing at near the maximum draw ratio and at a temperature in the range of 50° to 150° C.

Kavesh et al., in U.S. Pat. No. 4,413,110 (the disclosure of which is incorporated herein by reference), describe high tenacity polyethylene and polypropylene fibers made by means of a gel extrusion process; resultant polyethylene fibers have tenacities of 40 gpd and elongations of not more than 7%.

SUMMARY OF THE INVENTION

In general, the present invention provides a number of improved polypropylene fibers, all of which have an improved tenacity, an improved elongation, and/or an improved tensile factor. One such novel fiber is a polypropylene fiber, of staple or continuous length, having a tenacity of at least about 10 gpd and a tensile factor of at least about 60, preferably at least about 70, more preferably at least about 80, a preferred range being from about 60 to at least about 110 or more.

Another novel fiber provided by this invention is a polypropylene fiber have a tensile factor of at least about 60, more preferably of at least about 70, preferably in the range of from about 60 to about 110 or more, and having an elongation of at least about 25%, preferably at least about 35%, more preferably at least about 50%, even more preferably at least about 100%, still more preferably at least about 200%, with a preferred range of elongation being from about 25% to about 400% or more.

The present invention also provides novel high tenacity fibers with tenacities of at least about 10 gpd, preferably at least about 11 gpd, with a preferred range being from about 10 to about 12 gpd or more. In other preferred embodiments, these high tenacity fibers ($\geqq$10 gpd) have elongations of at least about 35%, preferably at least about 50%, more preferably at least about 100%, with a preferred range being from about 30% to about 135% elongation or more.

This invention also provides novel fibers having an improved tensile factor ($TE^{0.50}$), even where such fibers are not also high tenacity fibers. The benefits of high tenacity fibers generally translate into stronger, more durable yarns and stronger, more durable woven and nonwoven fabrics. In reinforcing applications, both higher tenacity fibers and those having an improved tensile factor provide better toughness and add strength to the matrix or bulk material being reinforced. The novel high tenacity fibers and those having an improved tensile factor are not mutually exclusive species; for reinforcing applications the novel fibers of this invention having both a tenacity of at least about 10 gpd and a tensile factor of at least about 60 are especially preferred, with those having a tenacity in the range from about 10 to about 15 gpd or more and those having a tensile factor in the range from about 60 to about 110 or more being more preferred. These novel fibers having an improved tensile factor preferably have $TE^{0.50}$ of at least about 62, more preferably at least about 65, and even more preferably at least about 70 or more, as well as having a tenacity of at least about 6.5 gpd, more preferably at least about 7.0, and even more preferably at least about 7.5 or more.

Yet, another embodiment of a fiber provided by this invention is a polypropylene fiber having a tensile factor of at least about 60, preferably at least about 70, and more preferably at least about 80, with a preferred range being from about 60 to about 110 or more. These novel fibers need not necessarily have a high tenacity because their improved tensile factor indicates that they have an improved elongation, and thus improved physical properties. The elongation of these fibers is generally at least about 25%, preferably at least about 100%, with a preferred range being from about 25% to about 400% or more. These novel fibers having an improved tensile factor of at least about 60 preferably also have a tenacity of at least about 8 gpd, more preferably at least 10 gpd, even more preferably at least about 11.5 gpd, with a preferred range being from about 8 gpd to about 15 gpd or more.

The novel fibers of this invention can be provided by a novel process of spinning at an elevated temperature, preferably of at least about 270° C., a polymer melt comprising, or consisting essentially of, polypropylene, thereafter drawing the fiber, preferably at an elevated temperature of at least about 70° C., and then heat-treating the fiber at an elevated temperature. Drawing of the fiber is preferably at an actual draw ratio of not more than about 6 (i.e., 1:6). The polymer melt preferably has a MFR (melt flow rate) of about 5.0 dg/min (decagram/minute) or less, preferably between about 0.3 and about 1.5, more preferably between about 0.3 and about 1.0, and even more preferably about 0.5, although melt flow rates lower than 0.3 can also be useful.

The novel fibers of this invention are useful for making woven fabrics, and in staple form for making nonwoven fabrics and as reinforcing fibers. An especially preferred use of these fibers is in staple form for reinforcing cementitious articles.

DETAILED DESCRIPTION OF SPECIFIC EMBODIMENTS

Figure 1:
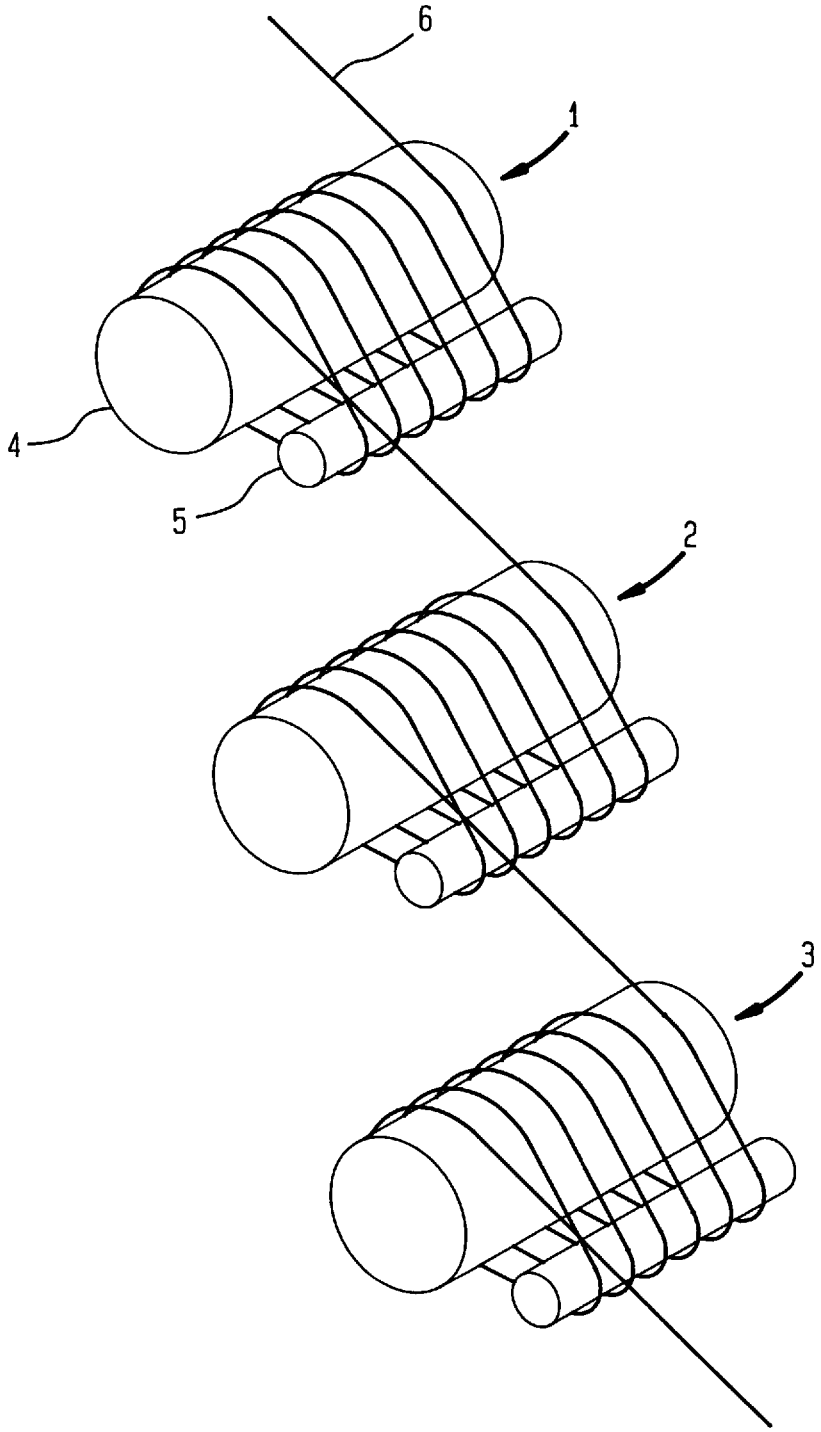
FIG. 1 is an idealized depiction of a bench-top apparatus useful for practicing the present invention.

Fiber-forming compositions for making the novel fibers of this invention include those derived from $C_{2-8}$ alkylene monomers, alone or in various combinations, and preferably comprise a propylene polymer, most preferably propylene homopolymer or a copolymer derived from at least 90% by weight of propylene monomer with the remainder derived from monomers selected from the group consisting of ethylene, butene, other olefinic monomers, and mixtures thereof. Examples of other olefinic monomers include 1-butene, 2-butene, 1-pentene, 2-pentene, 3-methyl-l-pentene, 4-methyl-1-pentene, 1,3-butadiene, isoprene, octene, styrene, methyl styrene, and the like, and mixtures thereof. Substituted olefinic monomers, such as fluoroethylene and vinyl chloride, are also suitable. The polypropylene can be manufactured by any of various processes, including a slurry process, liquid phase polymerization, or gas phase polymerization, preferably using a Ziegler-Natta or a metallocene catalyst (see, e.g., *Modern Plastics,* October 1995, p. 18–19, and *Chemical & Engineer News*, Sep. 11, 1995, pp. 15–20). A "fiber-forming" composition is preferably one in which fibers can be formed by melt spinning, although other spinning techniques can also be used; thus, preferred compositions are those that are melt-spinnable.

The fiber-forming composition may include one or more fiber-forming polymers compatible with the polyolefin (preferably polypropylene) in the form of a blend or alloy. It is preferred that the fiber-forming blend or alloy have at least 90% by weight of polypropylene, although at least 75% polypropylene content can be suitable for certain applications, with the minimum quantity of polypropylene being at least 50% by weight. Suitable polymers compatible with the polypropylene are generally selected from at least one of the following: other polyolefins; polyesters; polyacetals; acrylics (polyacrylates); polyamides; polyaramides; polyamides; polyarylenes (e.g., polyarylates); and the like; and mixtures thereof.

As noted above, the fibers of this invention are preferably formed by melt-spinning. The polymer melt for spinning is chosen to have a MFR of not more than about 5, more preferably about 1.5 or less, and even more preferably is in the range of 0.5 to 1.0, and down to about 0.3 if not even lower, as measured on a Melt Indexer according to ASTM D-1248. The polymer may be heat-stabilized using conventional additives in typical effective amounts to assure that the increase in MFR after melt-spinning is not more than about 0.1 dg/min. A preferred additive package for the melt includes distearyl thio dipropionate (DSTDP), titanium oxide ($TiO_2$), and calcium stearate (CaSt), all in amounts of from about 0.01% to about 2.0% by weight; preferably the additives are present in amounts of about 0.1% for the DSTDP and the $TiO_2$, and about 0.05% for the CaSt. Higher molecular weights (and thus lower melt flow rates) and broader molecular weight distributions allow for the polymer melt to be spun more easily; molecular weight is preferably determined on a weight average basis. As measured by the Hercules Incorporated method (see, e.g., G. R. Zetchner et al., *Proc.* 2nd World Conf. Chem. Eng., 6, 9 Montreal (1981) (the disclosure of which is incorporated herein by reference)), the molecular weight distribution is preferably in the range of from about 2 to about 10 by rheometrics, more preferably about 2.5–9, and even more preferably up to about 6 by rheometrics.

The polymer melt is preferably spun at a relatively high temperature compared with melt-spinning temperatures considered typical for making fibers of similar compositions. In particular, a melt-spinning temperature of at least about 245° C., preferably at least about 250, more preferably at least about 260°, even more preferably at least about 270°, and most preferably at least about 280° C., with a preferred range being from about 245° up to about 290° C. being used for making the as-spun fiber to the extent any degradation does not render the fiber ineffective for its desired function in the final article of manufacture. Contrary to the assumptions of the prior art, it does not appear to be critical that the as-spun fiber have a relatively low denier. As noted in the examples below, high tenacity fibers have been produced from as-spun fibers (i.e., prior to any significant drawing) having deniers of 14.8, 16, and 41.2 dpf. An as-spun fiber having a denier in the range of from about 0.5 to about 50 dpf or more, preferably from about 4 to about 45 dpf, more preferably from about 6 to about 30 dpf, and even more preferably from about 8 to about 16 dpf, is desired when making the novel fibers of this invention; also preferred are those having a final denier of about 4 (i.e., 3–5 dpf), about 15 (i.e., 13–17 dpf), and about 30 (i.e., 26–34 dpf).

The polymer preferably is spun at relatively low pressures to avoid melt fracture, a defect in the melt that is manifest in the spun fiber as alternating thick and thin sections, and is also manifest as a significantly increased coefficient of variability of the denier (C.V.; i.e., a fiber with a grossly varying thickness along its length). Melt fracture can be avoided by increasing the spinning temperature, but degradation of the polypropylene can result. Alternatively, the spinnerette holes can be enlarged, but then the denier of the as-spun fiber increases and so it must be subjected to a more extensive drawdown to reach the final denier desired. The person of ordinary skill in the spinning arts typically balances these parameters to control the pressure drop across the spinnerette.

The fibers can be spun to provide a round fiber, or devices, such as disclosed by Sibal in U.S. patent application Ser. No. 301,914, filed Sep. 7, 1994 (equivalent to European patent EP 705,923, the disclosures of which are both incorporated herein in their entireties by reference) for making multicomponent fibers, including non-round and trilobal fibers, are useful in this invention.

After the molten polymer is spun, it is quenched to solidify the melt. As is typical in melt spinning operations, the as-spun fiber is taken-up as it is spun, and so an additional draw can be induced in the fiber during this initial take-up of the as-spun fiber. If the fiber is spun vertically downward, then the effects of gravity provide an additional initial gravity-draw to the as-spun fiber. To facilitate this additional draw, and to avoid melt fracture, it is preferrable to control the application of the quench; the most preferred control includes quenching the fiber at a particular location relative to its exit from the spinnerette. Quenching of the fiber preferably is controlled to delay quenching until the fiber is at some predetermined distance downstream of the die opening of the spinnerette exit. One method of quenching in general is by directing a stream of quench fluid (typically air for polyolefins) at the fiber as it emerges from the spinnerette. A preferred method of controlling quenching in a delayed manner is to use a device such as a shroud, a shield protecting a portion of the fiber immediately adjacent the spinnerette exit from the quench fluid, or by directing the quench fluid effective to leave the immediately-exiting portion of the fiber unquenched for a predetermined distance beyond its exit from the die opening of the spinnerette. Another alternative is to have a recessed spinnerette or recessed die opening. Because a portion of the fiber is not quenched immediately when executing delayed quenching, the polymer melt that has exited the spinnerette is not yet fully solidified and can be subjected to a draw during the spinning operation (i.e., a "spun-drawn" fiber such as in Example 17, described below). It is preferred that the drawn-down, as-spun fiber have a denier of about 0.5–100 dpf, more preferably not more than about 2–50 dpf, and most preferably about 8–16 dpf.

After the as-spun and optionally drawn fiber is taken up, the fiber can be subsequently drawn and subjected to an elevated temperature (with respect to ambient) while, in preferred embodiments, the fiber is also subjected to drawing. It is preferred to use three sets of rolls for drawing, with the first two sets of rolls determining the draw ratio and the third set being used to treat the fiber at an elevated temperature. Preferably, all three rolls are at a superambient temperature, with the first two sets of rolls being at a temperature approximately equal to that of the fiber. Drawing is performed at temperatures generally of at least about 70°, preferably at least about 80°, and most preferably on the order of about 105°–110° C. or more. The draw ratio is in the range from greater than about 1 to about 12, more preferably up to about 6, still more preferably from about 2 to about 5, and even more preferably in the approximate range of from about 3 to about 4.5. Drawing apparatus typically have a means for displaying the draw ratio; calculation of the actual draw ratio (based on fiber denier) may be less if the fiber slips on the roll. The heat treatment performed on the third set of rolls preferably is done at a temperature of at least about 70°, with temperatures up to about 100°, up to about 120°, and even up to about 125° C. or more being suitable, with a preferred range of drawing temperatures being from about 70°to about 150° C. It is preferred that there be slippage on the heat setting roll; in fact, a certain amount of both adhesion and slippage typically occurs on each of the rolls. The draw ratio values given herein are based on the actual draw of the fibers unless otherwise noted. The fibers may also relax, but preferably should not be allowed to relax more than the amount of slippage, else the fiber will tend to wrap back onto the roll. Thus, each set of rolls is preferably maintained at a temperature at least equal to the temperature of the fiber coming the upstream processing; in the preferred embodiment, the second set of rolls is preferably 5°–10° C. hotter than the first set of rolls, and the third set of rolls, on which the heat treatment occurs, is preferably the hottest.

The fibers of this invention have an elongation of at least about 25%, preferably at least about 30%, more preferably at least about 35%, even more preferably at least about 50%, still more preferably at least about 100%, and even more preferably at least about 150%, with a preferred range of elongation being from about 30% to about 400% or more.

After drawing, the fiber may be cut into staple fibers, including both "short cut" staple fibers and staple fibers cut from crimped fiber; typically, short cut staple fibers are used as reinforcing fibers and incorporated into settable compositions, whereas crimped staple fibers are used in the fabrication of nonwoven fabrics. Staple fibers of this invention are useful for reinforcing asphalt-based and similar pavement compositions for roadways, runways, and other geoways, such as described in the aforementioned patent application Ser. No. 285,559, filed Aug. 3rd, 1994 (equivalent to Canadian laid-open application number 2,151,004, the disclosures of which are both incorporated herein in their entireties). Staple fibers are also useful for reinforcing cement concrete (e.g., based on Portland cement) used as pavement for geoways or as the base material for buildings and other supporting or architectural structures. An advantage of using staple fibers that comprise polypropylene for reinforcing cement concrete is that the fibers are not degraded by the alkaline environment of the cement. In general, staple fibers are useful for reinforcing cementitious compositions such as asphalt-based compositions (e.g., asphalt concrete pavement), water-settable inorganic mixtures (e.g., Portland cement, a mixture of sodium silicates and aluminates), thermoplastic and thermosetting resins, and the like, which are hardened (cured or set) from a liquid or flowable form. For reinforcing water-based settable cement concretes, the staple fibers of this invention generally have lengths of approximately 3–30 mm, preferably about 5–10 mm for reinforcing extruded concrete board, and preferably about 15–25 mm for reinforcing other concrete articles (e.g., cast concrete). Concrete board reinforced with the novel staple fibers of this invention is preferably made using a Hatschek machine, for example, for making such products as described by Johnson et al. in U.S. Pat. No. 4,428,775 (the disclosure of which is incorporated herein by reference). Staple fibers are preferably added in amounts of from about 0.01 wt. % to about 5 wt. % of the material being reinforced, depending on the amount of reinforcing desired and the cost increase incurred by adding a particular weight amount of reinforcing fibers.

The novel staple fibers of this invention are also useful for preparing nonwoven fabrics. In the manufacture of such nonwoven fabrics, continuous length fibers are preferably crimped before being cut into staple fibers, which then can be carded and bonded to produce a nonwoven mat suitable for use in such diverse articles as diapers and other absorbent articles (including tampons, catamenial devices, and surgical and dental absorbent articles), geotextiles, filtration media (for gas, liquid, and mixed phases), and catalyst and/or reaction media supports. Bonding of the crimped and carded staples fibers in the nonwoven mat can be accomplished by various techniques, examples including, without limitation, chemically, mechanically (e.g., needle punching), thermally (e.g., using laser energy or heating elements), or ultrasonically. To facilitate carding and bonding, the staple fibers are preferably crimped beforehand, using a device such as disclosed in U.S. Pat. No. 4,620,345, and preferably using the apparatus and method for crimping fiber for nonwoven applications as disclosed in U.S. Pat. No. 5,485,662 (the disclosures of which are both incorporated herein in their entireties by reference). In the manufacture of nonwoven fabrics, the novel staple fibers of this invention generally are provided in lengths in the range of about 10–100 mm.

The fibers of this invention are also useful in the form of continuous filaments for making woven fabrics, including industrial fabrics, geotextiles, and body armor (for both military and sports applications), as well as for making ropes and netting.

Various finishes, such as spin finishes and/or overfinishes, may be applied as desired, providing antistatic, lubricant, and/or such other properties as may be desired for processing the fibers of this invention into a particular article of manufacture. A preferred finish for cement-reinforcing applications is one which renders the fibers dispersible in a water-concrete mixture. Suitable finishes of this type include mixtures of ethoxylated fatty acid esters and ethoxylated alcohol phosphates, for example, a mixture of polyethylene glycol 400 monolaurate and polyoxyethylene(5)

tridecylphosphate neutralized with diethanolamine (available as LUROL® PP-912 from George A. Goulston Co., Monroe, N.C.). Hydrophilic finishes which have antistatic properties are also preferred, such as a neutralized phosphoric acid ester (such as sold as LUROL® AS-Y, available from George A. Goulston, Co., Monroe, N.C.). For asphalt-based reinforcement, as taught in those applications, the fiber preferably has a lipophilic (or asphaltaphilic) finish, such as described in U.S. Pat. No. 5,441,812 (the disclosure of which is incorporated herein in its entirety by reference). In these embodiments of lipophilic fibers, a hydrophobic finish may be applied to the fiber. Preferably for nonwoven articles, especially those comprised of carded and bonded crimped staple fibers, an antistatic composition, such as any of those described by the aforementioned Harrington applications, EP 0 557 024 A1 and U.S. patent application Ser. No. 08/016,346 (filed Feb. 11, 1993, a continuation of U.S. patent application Ser. No. 07/835,895, filed Feb. 14, 1992), Schmalz' patent U.S. Pat. No. 4,938,832 and application EP 0 486 158 A2 (corresponding to U.S. patent application Ser. No. 914,213, filed Jul. 15, 1992), and Johnson and Theyson, in U.S. Pat. No. 5,403,426 and EP 0 516 412 A2 (the disclosures of all of such patents and applications being incorporated herein by reference), is applied to the fiber. Suitable hydrophobic finishing compositions include an antistatic agent in combination with a lubricant such as a polysiloxane; more specific examples include potassium $C_4$- or $C_6$-alkyl phosphate with poly (dimethylsiloxane)s, and potassium $C_{10}$-alkyl phosphate with hydrogenated polybutene. If desired, a suitable lubricant can be incorporated into the fiber to obviate the need to use a lubricant in the finishing compositions, such as disclosed by Gupta and Harrington in U.S. application Ser. No. 512,351, filed Aug. 8, 1995 (the disclosure of which is incorporated herein by reference), which invention provides the benefit of enabling the significant reduction, if not the elimination, of the amount of lubricant applied to the fibers in addition to an antistatic agent.

Conventional stabilizers against degradation from heat, oxidation, and/or UV radiation, and/or other preservatives (e.g., Nuosept 95 preservative, from Nuodex Inc. division of Huls America, Inc., EPA Reg. No. 1100-85), as well as colorants, inert fragrances, and the like, may be added individually or in compatible combinations.

The invention will be further described with reference to the following examples, which are meant to illustrate specific embodiments and comparisons, and are not intended to be limiting with respect to the particular conditions and materials described. The term "as-spun" as used with reference to melt-spun fibers, refers to the fiber as it is when first taken up or able to be subjected to drawing or annealing operations; so, in the following examples, the term "spun-drawn" refers to spun-drawn fibers prior to subsequent processing according to this invention.

Figure 2:
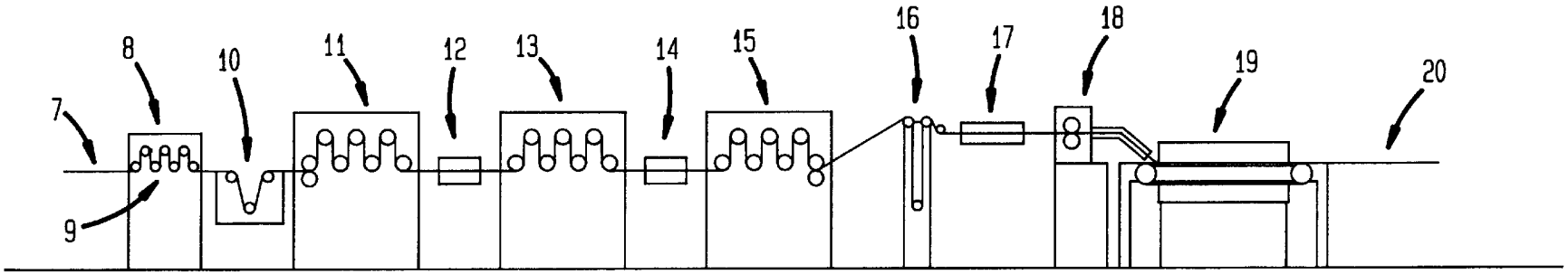
FIG. 2 is an idealized depiction of an industrial fiber processing scheme useful for practicing the present invention.

These examples of drawing and heat-treating were conducted on a bench-top apparatus like that shown in FIG. 1, in which a first set 1 and a second set 2 of rolls are used to draw the fiber and a third set 3 of rolls is used to effect the heat treatment. Each set of rolls is comprised of a larger roll 4 and smaller roll 5. The draw ratio is proportional to the ratio of the velocity of the second set of rolls to that of the first set. The fiber 6 from one or two packages is fed to the first set of rolls. In a commercial setting, the processing scheme depicted in FIG. 2 is useful for practicing the invention. In FIG. 2, a tow 7 from the creel is sent to a first operation, pretensioning 8. The various operations guide the tow and possibly effect the operation on the fibers in the tow by means of various rolls 9. Thereafter, the tow is sent through a dip tank 10 and then to the first set of rolls 11. The tow then passes through a steam chest 12 and into a second set of rolls 13, and then to another steam chest 14. At this point, the fiber will have been drawn according to this invention. Thereafter, the tow is sent to a third set 15 of rolls for heat treatment. At this point, the tow can be cut into staple fibers for reinforcing application. In the manufacture of a nonwoven product, the tow is then sent to the dancer rolls 16, another steam chest 17, and then to a crimper 18 (the circles denoting crimping rolls) as described above. The tow emerging from the crimper, which is typically wet because of the steam used in crimping, is fed by a conduit to a dryer 19, shown as a belted conveyor, and the dried fiber 20 is sent to a cutter (not shown) for the production of staple fibers; as mentioned above, these crimped staple fibers are then carded and bonded to produce a nonwoven article.

EXAMPLES 1–4

Using a polypropylene homopolymer having a MFR of 1.0 (available as Solvay 9000 from Solvay Polymers, Inc., Houston, Tex.), a melt was prepared and spun on a Davis Standard model 15VT-¾" extruder followed by a spin pump having a 675 hole spinnerette with 0.014" diameter outlet orifices. All temperature zones were at 260° C., air was used as the quench, and a 30 dpf fiber was spun.

Drawing was then performed under the conditions shown in Table 1, with the resulting physical properties also shown; $T_{1-2}$ is/are the temperature(s) of the first (and second) sets of drawing roll(s) (the first two sets of rolls are at approximately the same temperature if only one temperature is shown in the Table), and $T_3$ is the temperature of the third set comprising heat treating rolls.

EXAMPLES 5–7

The same general procedure as described for Example 1 was used to spin polypropylene fibers, except that all the temperature zones in the melt-spinner were at 250° C. and a spinnerette having 130 holes of a 0.030" diameter was used to provide a fiber having an as-spun denier of 41.2 dpf.

Drawing was then performed under the conditions shown in Table 1, with the resulting physical properties also shown; data in the column "$T_{roll\ 1-2}$" with a slash ("/") indicate the respective temperatures for the first and second sets of drawing rolls in the cases where such temperatures are not essentially the same.

EXAMPLES 8–10

Following the same general procedure as used for Examples 5–7, with temperature zones set to 260° C., a 32 dpf fiber was spun.

Drawing was then performed under the conditions shown in Table 1, with the resulting physical properties also shown.

EXAMPLE 11

Using the same general procedure as described for Example 1, a 13.8 dpf as-spun fiber was made using a spinning temperature of 280° C.; the fiber was then drawn under the conditions and tested to yield the resulting properties as both shown in Table 1.

EXAMPLES 12–13

Using the same general procedure as described for Example 1, a 13 dpf as-spun fiber was made using a spinning temperature of about 260° C. and then drawn under the conditions shown in Table 1 (Ex. 12). Thereafter, the drawn fiber was redrawn under the subsequent conditions shown (Ex. 13).

EXAMPLES 14–16

Using the same general procedure as described for Example 1, a 19 dpf as-spun fiber was made with resulting properties shown in Table I (Ex. 14), then drawn under the conditions shown in Table I (Ex. 15), and then redrawn under the conditions shown in Table 1 (Ex. 16).

EXAMPLE 17

Using the same general procedure as described for Example 1, fibers were spun-drawn at 240°–250° C. using a first set of take-up rolls at 200 mpm and a final set of take-up rolls at 300 mpm and heated to 95° C. so that the as-spun denier of about 25 dpf was decreased to about 17 dpf on the package (spin-draw ratio of about 1.5). Thereafter the fiber was drawn at 105° C. to provide a 8.4 dpf fiber with the properties shown in Table 1.

EXAMPLES 18–20

A 0.5 MFR polypropylene resin (available as AMOCO 6014 polypropylene from Amoco, Chocolate Bayou, Tex.) was spun at about 280° C. using a 1.5" (3.8 cm) shroud and the fibers were taken up at 400 mpm to yield a 16 dpf fiber; the MFR measured after spinning was 0.56. The fibers were then drawn, yielding improved properties, the drawing conditions and properties being shown in Table 1.

The 3% and 5% tensile moduli (analogous to the 2% secant (tensile) modulus described by Ahmed, op. cit.; that is, the slope of the stress-strain curve at 2% elongation) were 37.9 and 40.2 (Ex. 18), 40.6 and 38.8 (Ex. 19), and 55.5 and 54.7 (Ex. 20). In contrast, modulus values for polypropylene fibers are typically in the range of 15 to 25 gpd; the present invention can provide polypropylene fibers having moduli of greater than about 35, preferably greater than about 45, and even more preferably greater than about 55, with a preferred range of moduli values being from about 30 gpd to about 60 gpd or more.

EXAMPLE 21

Using the same general procedure as described for Examples 18–20, a 14.8 dpf as-spun fiber was made using a spinning temperature of about 280° C. and then drawn under the conditions, and tested to obtain the properties, shown in Table 1.

The 3% and 5% tensile module for these fibers were measured as 52.2 and 50.7 gpd.

EXAMPLE 22

Using the same general procedure as described for Examples 18–20, a 0.65 MFR polypropylene resin was spun and drawn under the conditions shown in Table I to yield the properties shown; after spinning, the polymer had a MFR of about 0.67.

The 3% and 5% tensile module were 60.7 and 60.4, respectively.

EXAMPLES 23–26

Using the same general procedure as described for Examples 18–20, 14.8 dpf as-spun fibers were formed (MFR=0.65 after spinning). These fibers were processed as noted to yield the results shown in Table 1.

The present invention has been described with reference to the foregoing embodiments and examples without being limited by the particular content thereof, and various additions, substitutions, deletions, and other modifications thereof are intended to be within the scope and spirit of the invention as defined by the following claims.

TABLE 1

| Example | $T_{1-2}$ | Draw Ratio | $T_3$ | dpf after drawing | % Elongation | Tenacity in gpd | Tensile Factor $TE^{0.50}$ |
|---|---|---|---|---|---|---|---|
| 1 | 54 | 3.9 | 86 | 9.35 | — | 3.26 | — |
| 2 | 25 | 3.56 | 106 | 8.41 | 301 | 3.84 | 66.6 |
| 3 | 80 | 3.3 | 121 | 8.03 | 159 | 3.5 | 44.1 |
| 4 | 98 | 3.3 | 135 | 5.44 | 158 | 5.75 | 72.3 |
| 5 | 116/111 | 3.43 | 127 | 12 | 85.7 | 8.2 | 75.9 |
| 6 | 116/111 | 3.43 | 127 | 12 | 114 | 9.2 | 98.2 |
| 7 | — | 3.44 | — | 12 | 129 | 10 | 113.6 |
| 8 | 80/110 | 11.47* | 127 | 11.6 | 92.5 | 9.15 | 88 |
| 9 | 87.96 | 11.6* | 89 | — | 89.8 | 7.6 | 72 |
| 10 | 87/96 | 13.0* | 89 | — | 110.2 | 7.05 | 74 |
| 11 | 90/102 | 14.7* | 113 | 3.81 | 97.3 | 8.5 | 84 |
| 12 | 100 | — | — | 11.7 | 230 | 4.38 | 66.4 |
| 13 | 100 | — | — | 9.12 | 139 | 5.6 | 66 |
| 14 | 25/25 | 0 | 25 | 19 | 444 | 3.1 | 65.3 |
| 15 | 100 | 5 | — | 8 | 100 | 7.4 | 74 |
| 16 | 100 | 5 | — | 10.6 | 182 | 5.5 | 74.2 |
| 17 | 105 | 4.9 | — | 8.4 | 75.9 | 9.55 | 83.2 |
| 18 | 70/70 | — | 70 | 6.2 | 81 | 9.5 | 85.5 |
| 19 | 70/80 | — | 100 | 6.6 | 79 | 7.3 | 64.9 |
| 20 | 70/100 | — | 125 | 4.5 | 37 | 10.6 | 64.5 |
| 21 | 75/90 | 4.4 | 127 | 3.37 | 66.8 | 10.46 | 85.4 |
| 22 | 105/110 | 4.97 | 127 | 2.98 | 59.6 | 11.52 | 88.9 |
| 23 | 25/25 | 1.05 | 25 | 14.1 | 400 | 3.0 | 60 |
| 24 | 80/80 | 1.85 | 25 | 8 | 129 | 5.7 | 64.7 |
| 25 | 105/110 | 2.3 | 25 | 6.44 | 63 | 8.2 | 65.1 |
| 26 | 105/110 | 2.55 | 127 | 5.8 | 79.5 | 8.9 | 79.4 |

*Nominal Machine Draw Ratio

What is claimed is:

1. A melt-spun fiber comprising a propylene polymer and having a tensile factor $TE^{0.50}$ of at least 60, wherein T is the tenacity of the fiber in grams per denier and is at least 10 gpd, and E is the percent elongation and is 25–400%.

2. The fiber of claim 1, having a tensile factor of at least 70.

3. The fiber of claim 2, having a tensile factor of at least 80.

4. The fiber of claim 1, wherein the fiber has a percent elongation E of at least 50%.

5. The fiber of claim 4, wherein the fiber has a percent elongation E at least 100%.

6. The fiber of claim 5, wherein the fiber has a percent elongation E of at least 150%.

7. The fiber of claim 6, wherein the fiber has a percent elongation E of at least 200%.

8. The fiber of claim 1, wherein the propylene polymer is a propylene copolymer derived from at least 90 wt. % propylene monomer.

9. The fiber of claim 8, wherein the remainder of the copolymer comprises at least one monomer selected from the group consisting of ethylene, 1-butene, 2-butene, 1-pentene, 2-pentene, 3-methyl-1-pentene, 1-methyl-1-pentene, 1,3-butadiene, isoprene, octene, styrene, fluoroethylene, vinyl chloride, and mixtures thereof.

10. The fiber of claim 9, wherein the monomer comprises ethylene.

11. The fiber of claim 1, comprising polypropylene homopolymer.

12. A melt-spun fiber comprising a propylene polymer and having a tensile factor $TE^{0.50}$ of at least 62, wherein T Is the tenacity of the fiber in grams per denier and is at least 6.5 grams per denier, and E is the percent elongation and is 25–400%.

13. The fiber of claim 12, having a tensile factor of at least 70.

14. The fiber of claim 13, having a tensile factor of at least 80.

15. The fiber of claim 12, wherein the fiber has a tenacity of at least 8 grams per denier.

16. The fiber of claim 15, wherein the fiber has a tenacity of at least 9 grams per denier.

17. The fiber of claim 16, wherein the fiber has a tenacity of at least 10 grams per denier.

18. The fiber of claim 12, wherein the fiber has a percent elongation E of at least 50%.

19. The fiber of claim 18, wherein the fiber has a percent elongation E at least 100%.

20. The fiber of claim 19, wherein the fiber has a percent elongation E of at least 150%.

21. The fiber of claim 20, wherein the fiber has a percent elongation E of at least 200%.

22. The fiber of claim 12, wherein the propylene polymer is a propylene copolymer derived from at least 90 wt. % propylene monomer.

23. The fiber of claim 22, wherein the remainder of the copolymer comprises at least one monomer selected from the group consisting of ethylene, 1-butene, 2-butene, 1-pentene, 2-pentene, 3-methyl-1-pentene, 4-methyl-1-pentene, 1,3-butadiene, isoprene, octene, styrene, fluoroethylene, vinyl chloride, and mixtures thereof.

24. The fiber of claim 23, wherein the monomer comprises ethylene.

25. The fiber of claim 12, comprising polypropylene homopolymer.

26. A melt-spun fiber comprising a propylene polymer and having a tensile factor $TE^{0.50}$ of at least 70, wherein T is the tenacity of the fiber in grams per denier and is at least 5.5 grams per denier, and E is the percent elongation and is 25–400%.

27. The fiber of claim 26, having a tensile factor of at least 80.

28. The fiber of claim 26, wherein the fiber has a percent elongation E of at least 35%.

29. The fiber of claim 28, wherein the fiber has a percent elongation E of at least 50%.

30. The fiber of claim 29, wherein the fiber has a percent elongation E at least 100%.

31. The fiber of claim 30, wherein the fiber has a percent elongation E of at least 150%.

32. The fiber of claim 31, wherein the fiber has a percent elongation E of at least 200%.

33. The fiber of claim 26, wherein the propylene polymer is a propylene copolymer derived from at least 90 wt. % propylene monomer.

34. The fiber of claim 33, wherein the remainder of the copolymer comprises at least one monomer selected from the group consisting of ethylene, 1-butene, 2-butene, 1-pentene, 2-pentene, 3-methyl-1-pentene, 4-methyl-1-pentene, 1,3-butadiene, isoprene, octene, styrene, fluoroethylene, vinyl chloride, and mixtures thereof.

35. The fiber of claim 34, wherein the monomer comprises ethylene.

36. The fiber of claim 26, comprising polypropylene homopolymer.

37. A melt-spun fiber comprising polypropylene and having a tenacity T in grams per denier of at least about 7.0 grams and a percent elongation E of 35–400%.

38. The fiber of claim 37, having a tensile factor of at least 70.

39. The fiber of claim 38, having a tensile factor of at least 80.

40. The fiber of claim 37, wherein the fiber has a percent elongation E of at least 50%.

41. The fiber of claim 40, wherein the fiber has a percent elongation E at least 100%.

42. The fiber of claim 41, wherein the fiber has a percent elongation E of at least 150%.

43. The fiber of claim 42, wherein the fiber has a percent elongation E of at least 200%.

44. The fiber of claim 37, wherein the propylene polymer is a propylene copolymer derived from at least 90 wt. % propylene monomer.

45. The fiber of claim 44, wherein the remainder of the copolymer comprises at least one monomer selected from the group consisting of ethylene, 1-butene, 2-butene, 1-pentene, 2-pentene, 3-methyl-1-pentene, 4-methyl-1-pentene, 1,3-butadiene, isoprene, octene, styrene, fluoroethylene, vinyl chloride, and mixtures thereof.

46. The fiber of claim 45, wherein the monomer comprises ethylene.

47. The fiber of claim 37, comprising polypropylene homopolymer.

48. A process for making a fiber as claimed in claim 1, comprising:

A. providing a spinnable polypropylene melt comprising polypropylene having a melt flow rate not more than about 5 dg/min;

B. injecting said melt through a spinnerette at a temperature of at least about 245° C. to produce a spun fiber;

C. quenching said spun fiber in a controlled manner to produce an as-spun fiber; and D. heat treating said fiber at a temperature of at least about 70° C. to produce said fiber.

49. The fiber of claim 12 having a denier of 0.5 to 50.

50. The fiber of claim 26 having a denier of 0.5 to 50.

51. The fiber of claim 27 having a denier of 0.5 to 50.

52. The fiber of claim 1 having an essentially circular cross section.

53. The fiber of claim 12 having an essentially circular cross section.

54. The fiber of claim 26 having an essentially circular cross section.

55. The fiber of claim 37 having an essentially circular cross section.

56. The fiber of claim 1 having an essentially non-circular cross section.

57. The fiber of claim 12 having an essentially non-circular cross section.

58. The fiber of claim 26 having an essentially non-circular cross section.

59. The fiber of claim 37 having an essentially non-circular cross section.

60. The fiber of claim 1 having a denier of 0.5 to 50.

* * * * *